US010407974B2

(12) United States Patent
Raby et al.

(10) Patent No.: US 10,407,974 B2
(45) Date of Patent: Sep. 10, 2019

(54) MODULAR CHANNEL ASSEMBLIES FOR DOORS

(71) Applicant: ASSA ABLOY DOOR GROUP INC.

(72) Inventors: Larry Raby, New Haven, CT (US); Gisele Sharifi, New Haven, CT (US); Steve Everett, New Haven, CT (US)

(73) Assignee: ASSA ABLOY DOOR GROUP INC., Milan, TN (US)

( * ) Notice: Subject to any disclaimer, the term of this patent is extended or adjusted under 35 U.S.C. 154(b) by 0 days.

(21) Appl. No.: 15/793,480

(22) Filed: Oct. 25, 2017

(65) Prior Publication Data

US 2018/0119477 A1 May 3, 2018

Related U.S. Application Data

(60) Provisional application No. 62/415,803, filed on Nov. 1, 2016.

(51) Int. Cl.

| | |
|---|---|
| ***E05F 3/22*** | (2006.01) |
| ***E06B 1/12*** | (2006.01) |
| ***E06B 1/52*** | (2006.01) |
| ***E06B 1/70*** | (2006.01) |

(52) U.S. Cl.

CPC ..... *E06B 1/12* (2013.01); *E05F 3/22* (2013.01); *E06B 1/52* (2013.01); *E06B 1/70* (2013.01)

(58) Field of Classification Search

CPC .. E06B 3/822; E06B 3/827; E06B 2003/7046; E06B 2003/7088; Y10T 70/8541

USPC ..... 52/784.12, 784.13

See application file for complete search history.

(56) References Cited

U.S. PATENT DOCUMENTS

| | | | | |
|---|---|---|---|---|
| 1,231,289 A * | 6/1917 | Otte | E04B 2/58 | 52/211 |
| 1,587,771 A * | 6/1926 | Goddard | E05B 9/08 | 292/DIG. 33 |
| 2,732,044 A * | 1/1956 | McClune | E04B 1/6141 | 52/578 |
| 4,467,562 A * | 8/1984 | Hemmerling | E05D 15/063 | 49/411 |
| 4,561,212 A * | 12/1985 | Ullman, Jr. | E05B 9/00 | 49/503 |

(Continued)

*Primary Examiner* — Christine T Cajilig

(74) *Attorney, Agent, or Firm* — DeLio Peterson & Curcio LLC; Thomas E. Ciesco

(57) ABSTRACT

A modular channel for a door including an elongated channel forming at least a portion of an internal frame for the door. The elongated channel has opposing sides and a base member extending between one edge of each side. The modular channel includes a pair of parallel slotted openings along the base member and a channel adapter including a tabs corresponding with the pair of slotted openings. The tabs include a locking protrusion extending from tab. The tabs slidably engage the slotted openings and the locking protrusions engage the slotted openings when the tabs are urged fully into the slotted opening. The slotted openings may be positioned parallel with the elongated channel length and the elongated channel may include at least one transverse slot perpendicular to the slotted openings. The channel adapter may include a curved locking tongue disposed perpendicular to the tabs and engagable with the transverse slot.

20 Claims, 12 Drawing Sheets

(56) References Cited

U.S. PATENT DOCUMENTS

| | | | | |
|---|---|---|---|---|
| 6,230,459 | B1 * | 5/2001 | Jeffers | E04B 2/7433 52/239 |
| 8,136,327 | B1 * | 3/2012 | Sokol | E06B 3/822 52/784.1 |
| 8,316,620 | B2 * | 11/2012 | Cotlet | E06B 3/822 52/784.1 |
| 2010/0115862 | A1 * | 5/2010 | Young | E05B 9/002 52/204.1 |
| 2015/0204134 | A1 * | 7/2015 | Wong | E06B 5/113 49/506 |
| 2015/0345204 | A1 * | 12/2015 | Vandervelden | E05D 15/0626 49/352 |

* cited by examiner

MODULAR CHANNEL ASSEMBLIES FOR DOORS

BACKGROUND OF THE INVENTION

The present invention relates to channel assemblies for a door, and in particular, door channel assemblies which adapt to allow connection of a variety of door hardware to the door.

SUMMARY OF THE INVENTION

Bearing in mind the problems and deficiencies of the prior art, it is therefore an object of the present invention to provide a door channel mountable to a door for attaching door components or door accessories.

It is another object of the present invention to provide a door channel which can be populated with modular adapters or assemblies on site.

It is a further object of the present invention to provide a door channel which is engagable with a various modular components, allowing easy installation and replacement of the modular components.

It is still another object of the present invention to provide a door channel which does not require welding for assembly, reducing manufacturing time and cost.

Still other objects and advantages of the invention will in part be obvious and will in part be apparent from the specification.

The above and other objects, which will be apparent to those skilled in the art, are achieved in the present invention which is directed to a modular channel for a door comprising an elongated channel forming at least a portion of an internal frame for the door, the elongated channel having opposing sides with opposing side edges, and a base member extending between one edge of the sides. The modular channel includes a pair of parallel slotted openings along a portion of the base member and a channel adapter including a pair of tabs corresponding with the pair of slotted openings, the tabs including a locking protrusion extending from tab. The tabs slidably engage the slotted openings and the locking protrusions engage the slotted openings when the tabs are urged fully into the slotted opening. The slotted openings may be positioned parallel with the elongated channel length and the elongated channel may include at least one transverse slot perpendicular to the pair of slotted openings. The channel adapter may include a curved locking tongue disposed perpendicular to the tabs and engagable with the transverse slot. The modular channel may include at least one additional pair of parallel slotted openings wherein the channel adapter may slidingly engage either pair of parallel slotted openings. The channel adapter may include openings to engage hardware for a motion switch. The locking protrusions may include at least one angled surface which temporarily deforms a portion of the slot as the tab is urged into the slot until the protrusion fully passes through the slot, preventing the protrusion from backing out of the slot. The channel adapter may include openings to engage hardware for a closer mount. The channel adapter may include openings to engage hardware for a concealed overhead closer. The channel adapter may include openings to engage hardware for a flush bolt clip. The channel adapter may include openings to engage hardware for a vertical rod. The channel adapter may include openings to engage hardware for a support. The channel adapter may include openings to engage hardware for a position switch.

Another aspect of the present invention is directed to a door assembly comprising a door having an opening in an edge thereof, an elongated channel secured in the door edge opening and forming at least a portion of an internal frame for the door, the channel having opposing sides with opposing side edges, and a base member extending between one edge of the sides and a pair of parallel slotted openings along a portion of the base member. The door assembly includes a channel adapter having a pair of tabs corresponding with the pair of slotted openings, the tabs including a locking protrusion extending from tab. The tabs slidably engage the slotted openings and the locking protrusions engage the slotted openings when the tabs are urged fully into the slotted opening.

Another aspect of the present invention is directed to a method of installing a door using a modular door channel. The method includes providing an elongated channel forming at least a portion of an internal frame for the door, the elongated channel having opposing sides and a base member extending between one edge of the sides, the elongated channel having a pair of parallel slotted openings along a portion of the base member. The method includes providing a door having an edge opening for engaging the elongated channel and a channel adapter including a pair of tabs corresponding with the pair of slotted openings, the tabs including a locking protrusion extending from tab. The method includes securing the elongated channel within the door edge opening, positioning the channel adapter wherein the pair of tabs is aligned with the pair of parallel slotted openings and urging the pair of tabs fully into the parallel slotted openings until the locking protrusions pass through the parallel slotted openings, locking the channel adapter into the elongated channel. The slotted openings may be positioned parallel with the elongated channel length and the elongated channel may include at least one transverse slot perpendicular to the pair of slotted openings and the channel adapter may include a curved locking tongue disposed perpendicular to the tabs and engagable with the transverse slot. The step of positioning the channel adapter may include inserting the locking tongue into the at least one traverse slot. The elongated channel may include at least one additional pair of parallel slotted openings wherein the channel adapter may slidingly engage either pair of parallel slotted openings. The locking protrusions may include at least one angled surface which temporarily deforms a portion of the slot as the tab is urged into the slot until the protrusion fully passes through the slot, preventing the protrusion from backing out of the slot. The step of urging the pair of tabs fully into the parallel slotted openings may include allowing the at least one angled surface to deform a portion of the slot.

Another aspect of the present invention is directed to a method of installing a door using a modular door channel. The method includes providing an elongated channel having a width, opposing sides and a base member extending between one edge of the sides, a plurality of parallel slotted opening pairs along a portion of the base member, the slots of the slotted openings parallel with the length of the elongated channel, and at least one transverse slot extending perpendicular to the slots of the slotted openings. The method includes providing a door and a channel adapter including a pair of tabs corresponding with the pairs of slotted openings, the tabs including a locking protrusion extending from tab, the channel adapter including a tongue perpendicular to the tabs. The method includes securing the elongated channel to form at least a portion of an internal frame for the door and positioning the channel adapter at a desired location at an angle to the elongated channel wherein the tongue is aligned with one of the transverse slots. The method includes inserting the tongue into the at least one transverse slots and rotating the channel adapter, and urging the pair of tabs fully into the one of the pairs of parallel slotted openings until the locking protrusions pass through the parallel slotted openings, locking the channel adapter into the elongated channel. The slotted openings may be positioned parallel with the elongated channel length and the elongated channel include at least one transverse slot perpendicular to the pair of slotted openings and the channel adapter may include a curved locking tongue disposed perpendicular to the tabs and engagable with the transverse slot and the step of positioning the channel adapter includes inserting the locking tongue into the at least one traverse slot. The locking protrusions may include at least one angled surface which temporarily deforms a portion of the slot as the tab is urged into the slot until the protrusion fully passes through the slot, preventing the protrusion from backing out of the slot and the step of urging the pair of tabs fully into the parallel slotted openings may include allowing the at least one angled surface to deform a portion of the slot.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiments of the present invention, reference will be made herein to FIGS. 1-32 of the drawings in which like numerals refer to like features of the invention.

Figure 1:
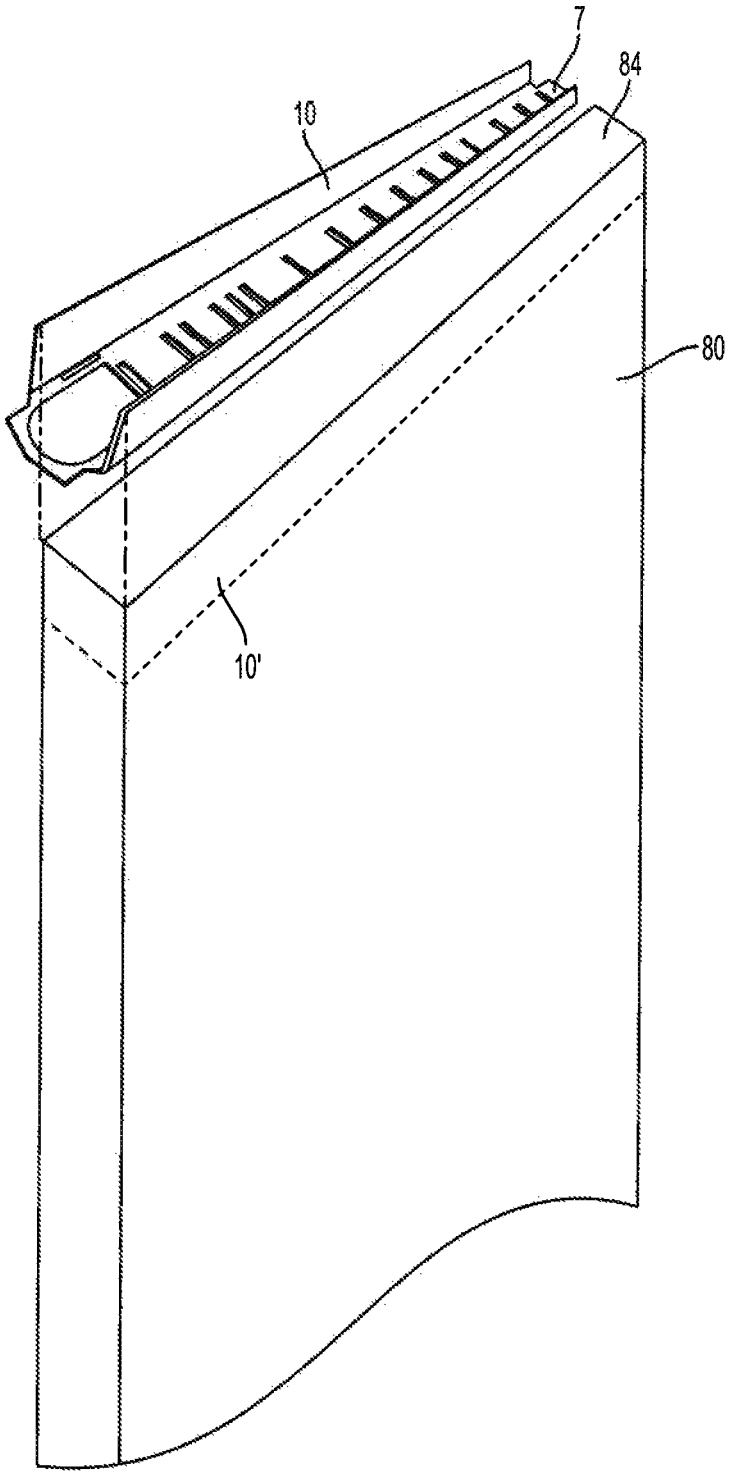
FIG. 1 is an exploded perspective view of the modular channel assembly installed in a door according to the present invention.

FIG. 1 is an exploded perspective view of the modular channel 10 and door 80 into which the modular channel 10 may be employed. Modular channel 10 may form all or a portion of an internal frame or structural support 10' within openings in door 80 along top, bottom or side edges 84, or any other peripheral or internal location within the door. A channel tab 7 may be inserted for securing the modular channel 10 into other frame members in the internal door framework. Door skins and finished door edging may be installed over the modular channel pieces to finish the exterior of the door, and components may be attached to the modular channel pieces internally, as described below.

FIGS. 2-6 include the modular channel 10 which has a base member 12 and channel sides 14. The modular channel assembly includes various adapters including a flush bolt clip 20, an adapter for a door position switch 21, a flush bolt clip with a mounting opening for a door position switch 22, a hardware adapter for a vertical rod guide 23, a second embodiment of an adapter for a door position switch 24 and a concealed overhead closer adapter 25.

Figure 7:
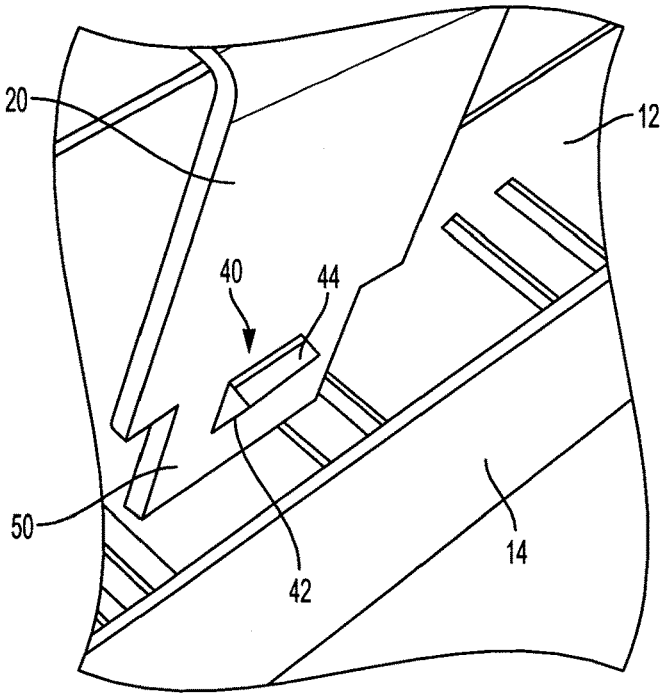
FIG. 7 is an enlarged perspective view of a portion of the flush bolt clip showing the protrusion.
Figure 8:
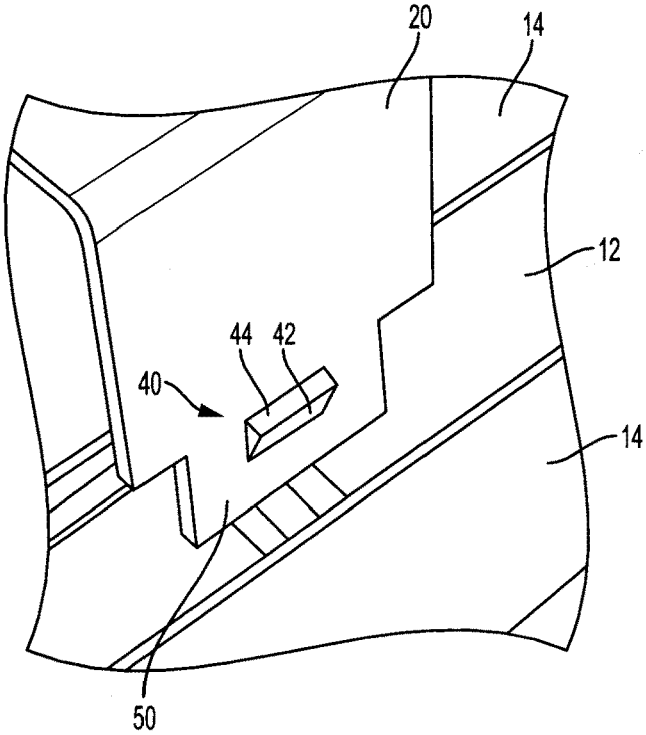
FIG. 8 is a second enlarged perspective view of a portion of the flush bolt clip showing the protrusion.
Figure 9:
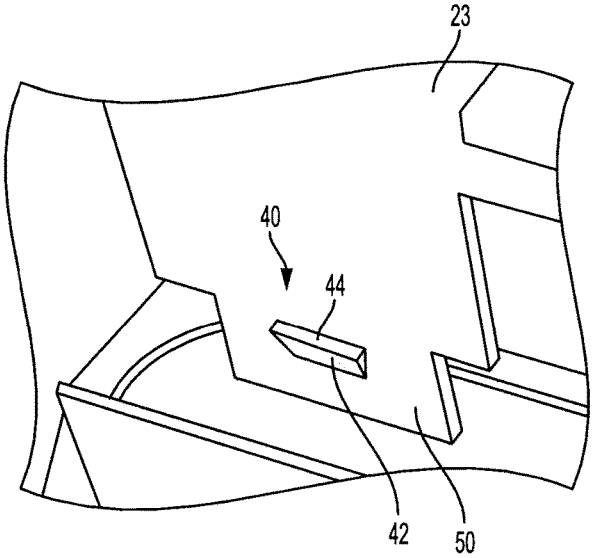
FIG. 9 is an enlarged perspective view of a portion of hardware adapter for a vertical rod guide showing the protrusion.
Figure 10:
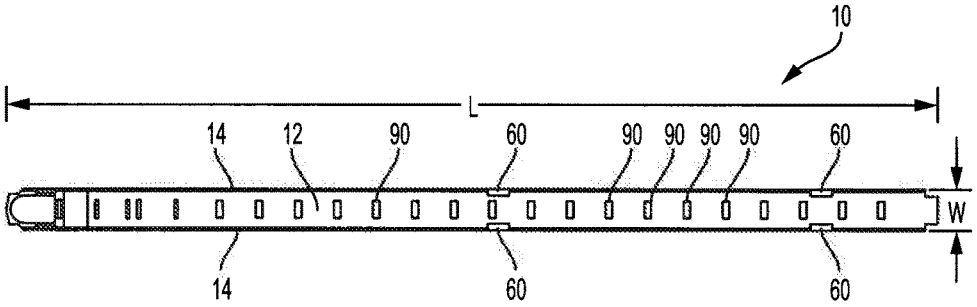
FIG. 10 is a front elevational view of the modular channel according to the present invention.
Figure 11:
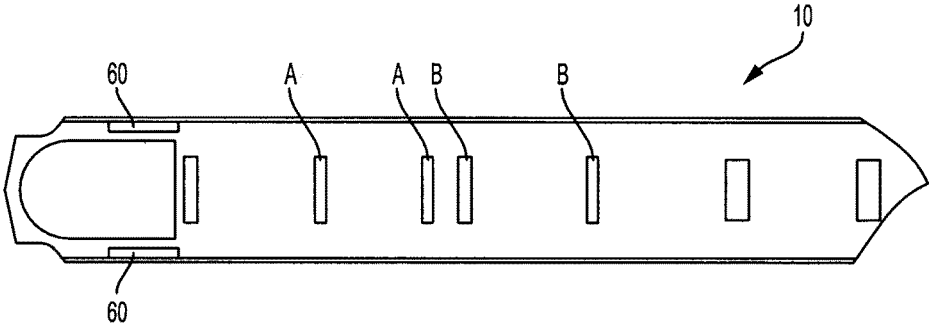
FIG. 11 is a front elevational view of a portion of the modular channel shown in FIG. 10.
Figure 12:
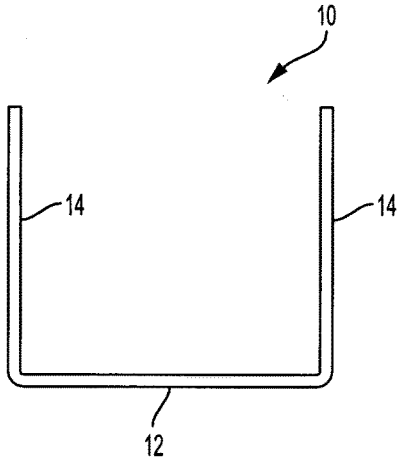
FIG. 12 is a right side elevational view of the modular channel shown in FIG. 10.
Figure 13:
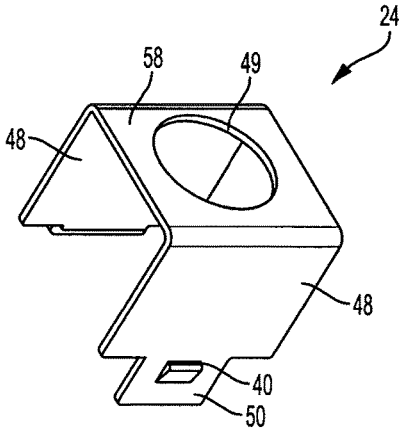
FIG. 13 is a perspective view of the door position switch adapter according to the present invention.
Figure 14:
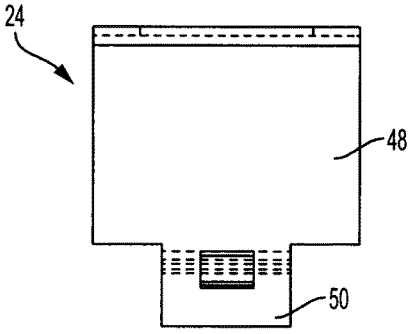
FIG. 14 is a top elevational view of the door position switch adapter shown in FIG. 13.
Figure 15:
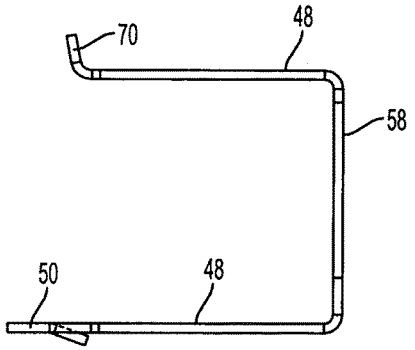
FIG. 15 is a right elevational view of the door position switch adapter shown in FIG. 13.
Figure 16:
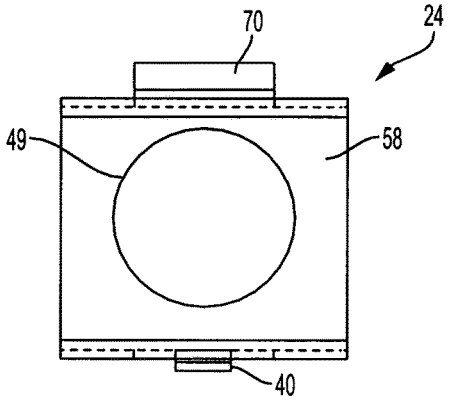
FIG. 16 is a front elevational view of the door position switch adapter shown in FIG. 13.
Figure 17:
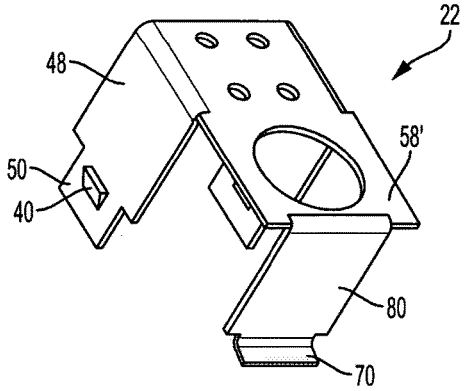
FIG. 17 is a perspective view of the flush bolt and door position clip according to the present invention.
Figure 18:
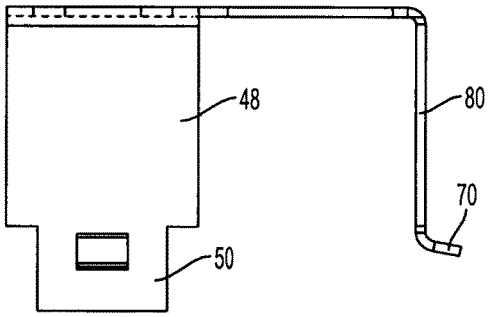
FIG. 18 is a right elevational view of the flush bolt and door position clip shown in FIG. 17.
Figure 19:
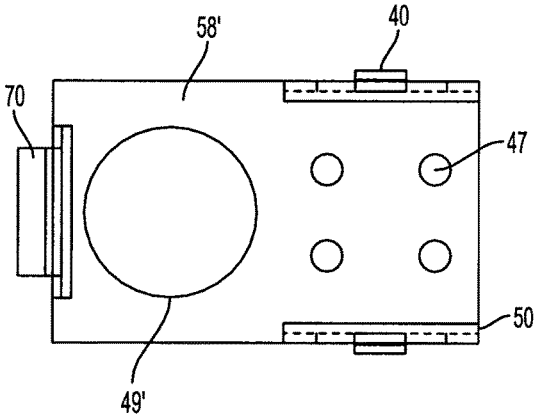
FIG. 19 is a front elevational view of the flush bolt and door position clip shown in FIG. 17.
Figure 20:
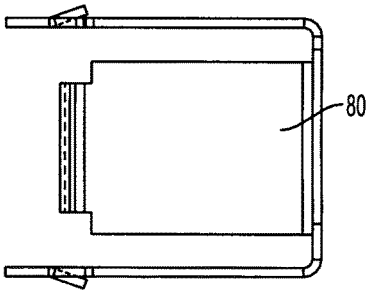
FIG. 20 is a top elevational view of the flush bolt and door position clip shown in FIG. 17.
Figure 21:
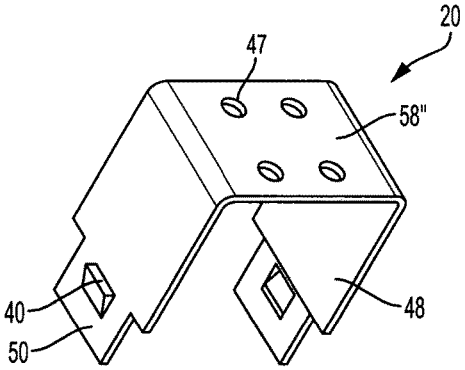
FIG. 21 is a perspective view of the flush bolt clip according to the present invention.
Figure 22:
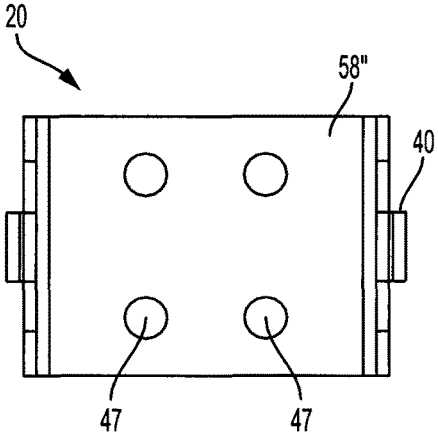
FIG. 22 is a right elevational view of the flush bolt clip shown in FIG. 21.
Figure 23:
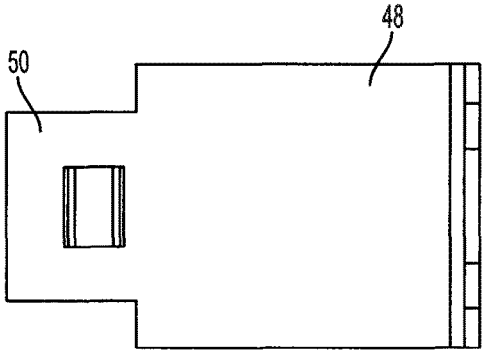
FIG. 23 is a front elevational view of the flush bolt clip shown in FIG. 21.
Figure 24:
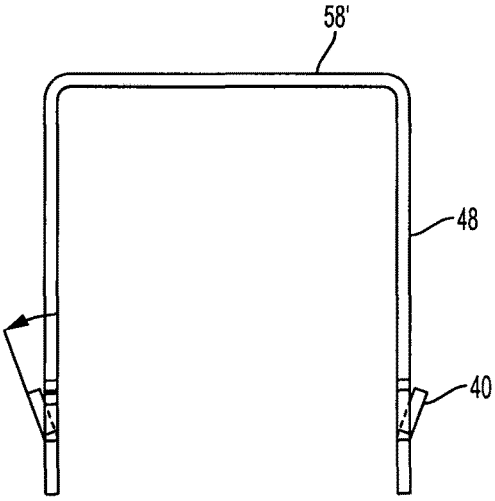
FIG. 24 is a top elevational view of the flush bolt clip shown in FIG. 21.
Figure 25:
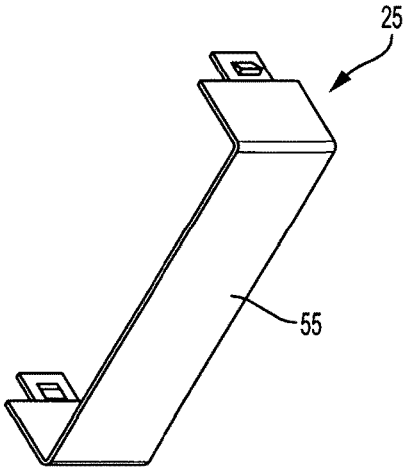
FIG. 25 is a perspective view of the concealed overhead adapter according to the present invention.
Figure 26:
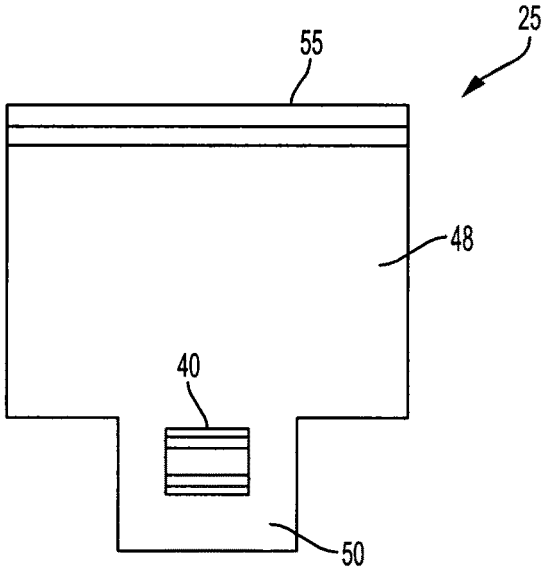
FIG. 26 is a right elevational view of the concealed overhead adapter shown in FIG. 21.
Figure 27:
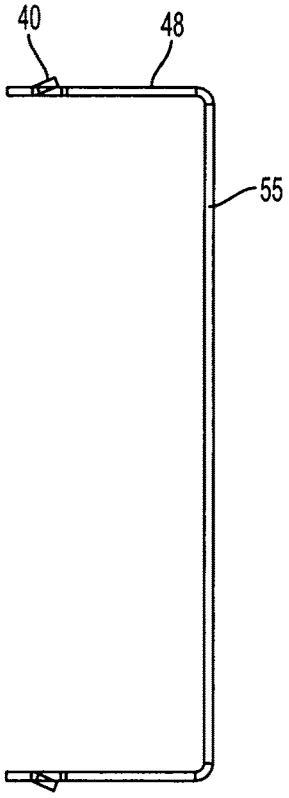
FIG. 27 is a front elevational view of the concealed overhead adapter shown in FIG. 21.
Figure 28:
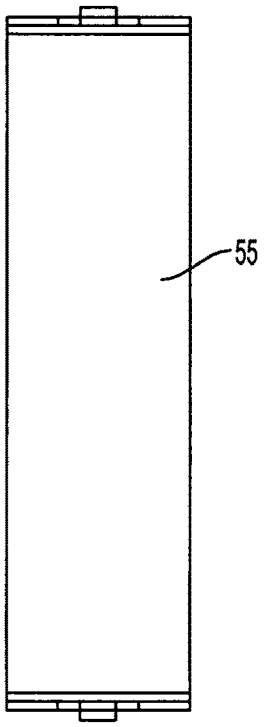
FIG. 28 is a top elevational view of the concealed overhead adapter shown in FIG. 21.
Figure 29:
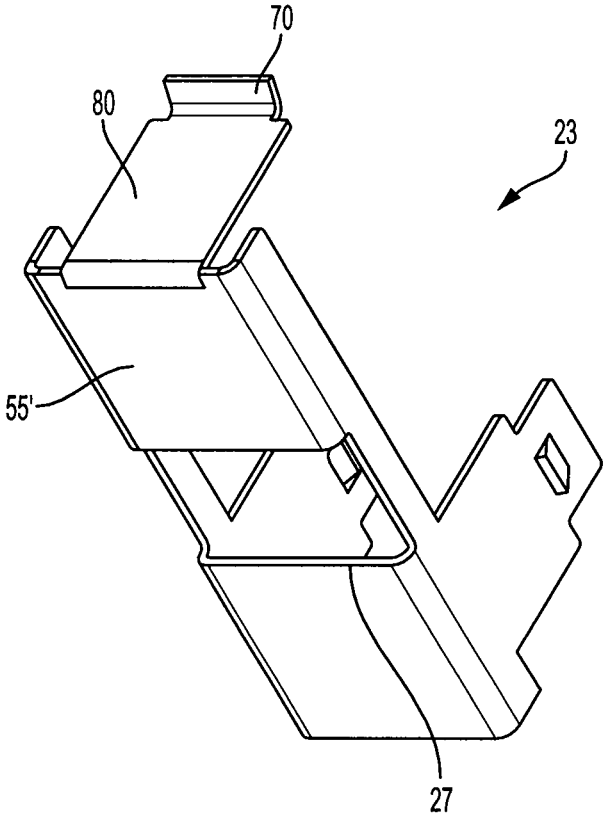
FIG. 29 is a perspective view of the vertical rod guide according to the present invention.
Figure 30:
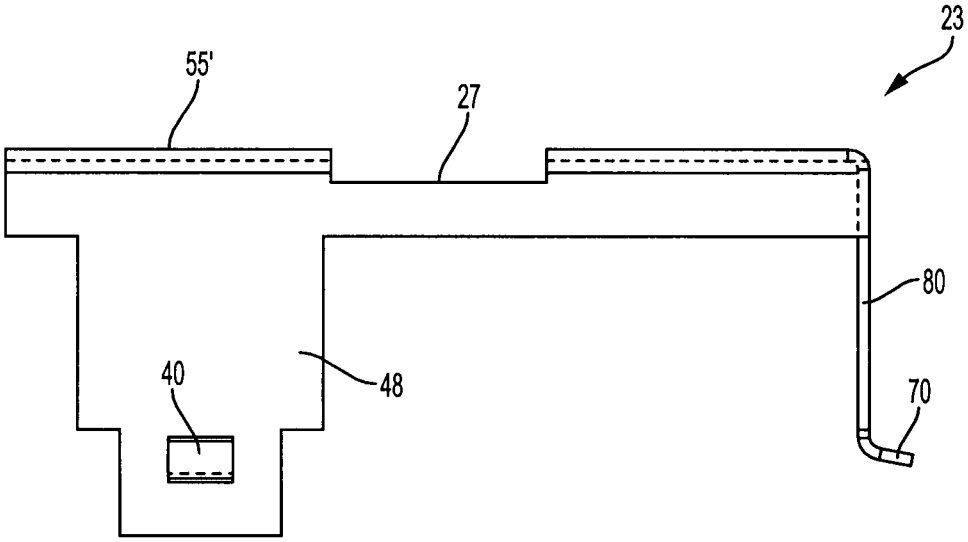
FIG. 30 is a right elevational view of the vertical rod guide shown in FIG. 29.
Figure 31:
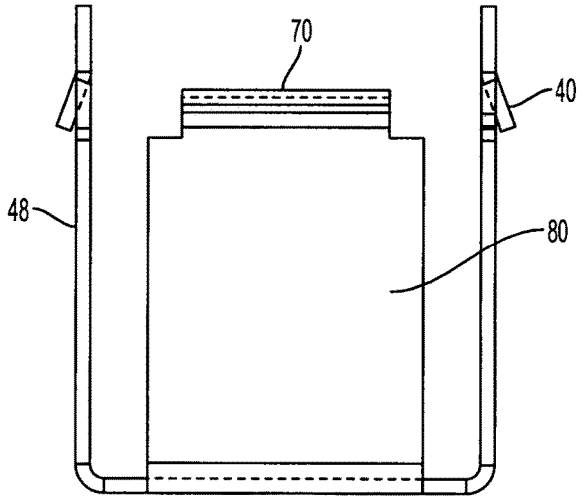
FIG. 31 is a front elevational view of the vertical rod guide shown in FIG. 29.
Figure 32:
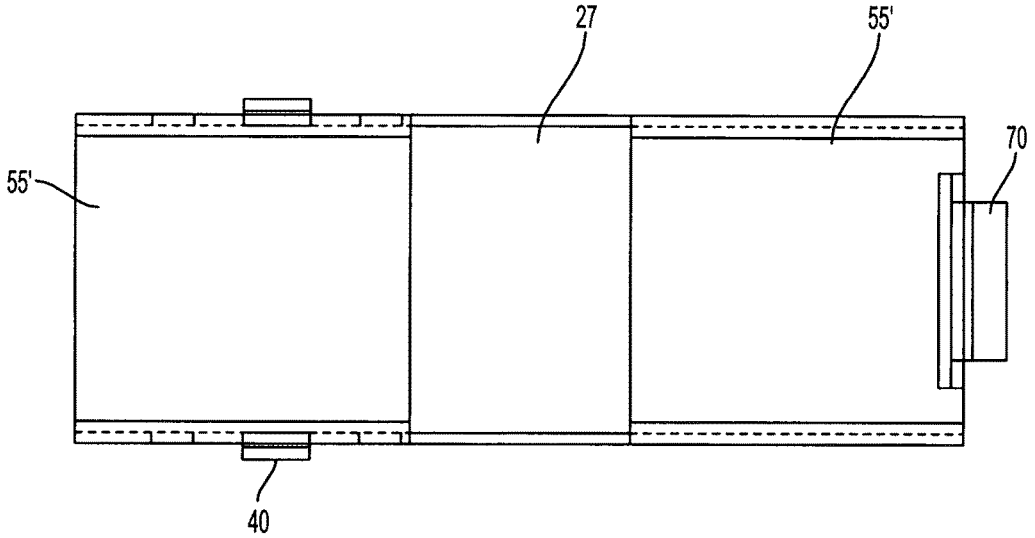
FIG. 32 is a top elevational view of the vertical rod guide shown in FIG. 29.

The tab portion of the adapters is shown in enlarged FIGS. 7-9 which show the adapters having an adapter face 58 and a pair of adapter support members or support struts 48 extending from the adapter face 58 to one of the slotted pairs 60 when the adapter is engaged with the elongated channel 10. The adapter includes a tab 50 extending from the adapter support struts 48, the tab engagable with the slots 60. The tabs 50 include protrusions 40 which are forced or otherwise urged through the slots 60 to lock the tabs 50 into the slots 60. The protrusions 40 may include a flat surface 42 angled to deform the slots as the tabs 50 are urged through the slots, and an upper surface 44 which locks the tabs in place. FIGS. 10-32 show examples of various adapters which may be secured in the modular channel 10, which include the flush bolt clip 20, an adapter for a door position switch 21, a flush bolt clip with a mounting opening for a door position switch 22, a hardware adapter for a vertical rod guide 23, a second embodiment of an adapter for a door position switch 24 and a concealed overhead closer adapter 25.

The elongated channel has a length L and a width W. The base member 12 includes a plurality of slot pairs 60 which can be seen in the front view of the modular channel 10 of FIGS. 10 and 11. The slots in the slotted pairs 60 are positioned parallel with the length L of the channel. The elongated channel 10 also includes a plurality of transverse slots 90 perpendicular to the channel length. The transverse slots 90 are for engaging a tongue 70 in the adapters of FIGS. 2, 4, 5A 15, 17, 18 and 29, the tongues 70 being optional in some of the adapter embodiments. The tongue 70 may be a curved flange for engaging one of the slots 90 by placing the adapter at an angle within the channel 10 as indicated by rotation arrow 6 in FIG. 5A, inserting the tongue into the slot 90 and rotating in the opposite directions until the tabs 50 engage the slots 60. Once the tabs protrusions 40 pass fully into the slotted openings 60, the adapter is secured in the channel 10 by the protrusions 40 as well as the tongue 70.

FIGS. 13-16 show a door position switch adapter 24 for mounting a position switch to the door. The adapter 24 includes a face 58 and a pair of support struts 48 attached to the face 58 along one edge of the support strut 48 and includes a tab 50 extending from the opposite edge of the support strut 48. The tabs 50 engage the transverse slots 90, positioning the support struts 48 across the channel 10 length. One of the support struts 48 includes a curved locking tongue 70 disposed on one of the tabs 50, the curved locking tongue 70 engagable with the transverse slot 90. The door position switch adapter 24 includes a switch opening 49 for attaching a door position switch. The door position switch adapter 24 is attached to the channel 10 by inserting the tongue 70 into one of the slots 90 while the adapter 24 is at an angle sufficient to insert the tongue 70 and then rotating the adapter 24 about the tongue 70 until the opposite tab 50 engages a second slot 90.

FIGS. 17-20 show a flush bolt and door position switch adapter 22. The adapter 22 includes a face 58' and a pair of support struts 48 attached to the face 58' along one edge of the support strut 48 and includes a tab 50 extending from the opposite edge of the support strut 48. The tabs 50 engage the transverse slots 90, positioning the support struts 48 across the channel 10 length. A traverse support strut 80 is positioned perpendicular to the support struts 48 and includes a curved locking tongue 70 disposed on the transverse support strut 80. The curved locking tongue 70 is engagable with the transverse slot 90 and the support struts 48 are engagable with one of the slotted pairs 60. The flush bolt and door position switch adapter 22 includes a switch opening 49' for attaching a door position switch and a plurality of fastener openings 47 to mount a flush bolt. The flush bolt and door position switch adapter 22 is attached to the channel 10 by inserting the tongue 70 into one of the slots 90 while the adapter 24 is at an angle sufficient to insert the tongue 70 and then rotating the adapter 24 about the tongue 70 until the tabs 50 engages one of the slotted pairs 60 and the protrusions 40 locks the tabs 50 into the slots 60.

FIGS. 21-24 show a flush bolt adapter 20 for mounting a flush bolt to the door. The adapter 20 includes a face 58" and a pair of support struts 48 attached to the face 58" along one edge of the support strut 48 and includes a tab 50 extending from the opposite edge of the support strut 48. The tabs 50 engage the slotted pairs 60, positioning the support struts 48 along the channel 10 length. The flush bolt adapter 20 includes plurality of fastener openings 47 to mount a flush bolt. The flush bolt adapter 20 is attached to the channel 10 by inserting tabs 50 into one of the slotted pairs 60 until the protrusions 40 engage the slots 60.

FIGS. 25-28 show a concealed overhead adapter 25 including a face 55 and a pair of support struts 48 attached to the face 55 along one edge of the support strut 48 and includes a tab 50 extending from the opposite edge of the support strut 48. The tabs 50 engage the transverse slots 90, positioning the support struts 48 across the channel 10 length. The concealed overhead adapter 25 is attached to the channel 10 by inserting tabs 50 into two of the transverse slots 90 until the protrusions 40 engage the transverse slots 90.

FIGS. 29-32 show a vertical rod guide adapter 23. The adapter 23 includes a face 58' and a pair of support struts 48 attached to the face 55' along one edge of the support strut 48 and includes a tab 50 extending from the opposite edge of the support strut 48. The tabs 50 engage the transverse slots 90, positioning the support struts 48 across the channel 10 length. A traverse support strut 80 is positioned perpendicular to the support struts 48 and includes a curved locking tongue 70 disposed on the transverse support strut 80. The curved locking tongue 70 is engagable with the transverse slot 90 and the support struts 48 are engagable with one of the slotted pairs 60. The vertical rod guide adapter 23 includes a guide opening 27 and is attached to the channel 10 by inserting the tongue 70 into one of the slots 90 while the adapter 23 is at an angle sufficient to insert the tongue 70 and then rotating the adapter 23 about the tongue 70 until the tabs 50 engages one of the slotted pairs 60 and the protrusions 40 locks the tabs 50 into the slots 60.

Figure 2:
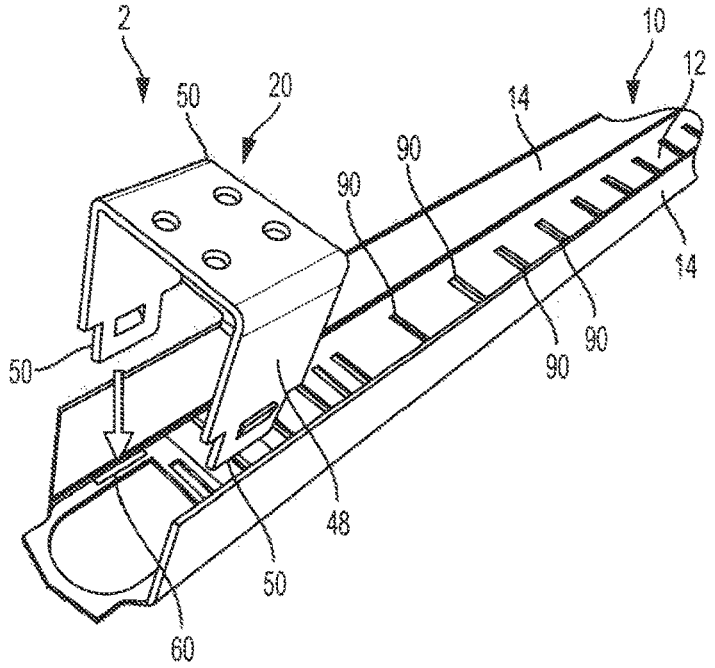
FIG. 2 is an exploded perspective view of a portion of the modular channel including a flush bolt clip.
Figure 3:
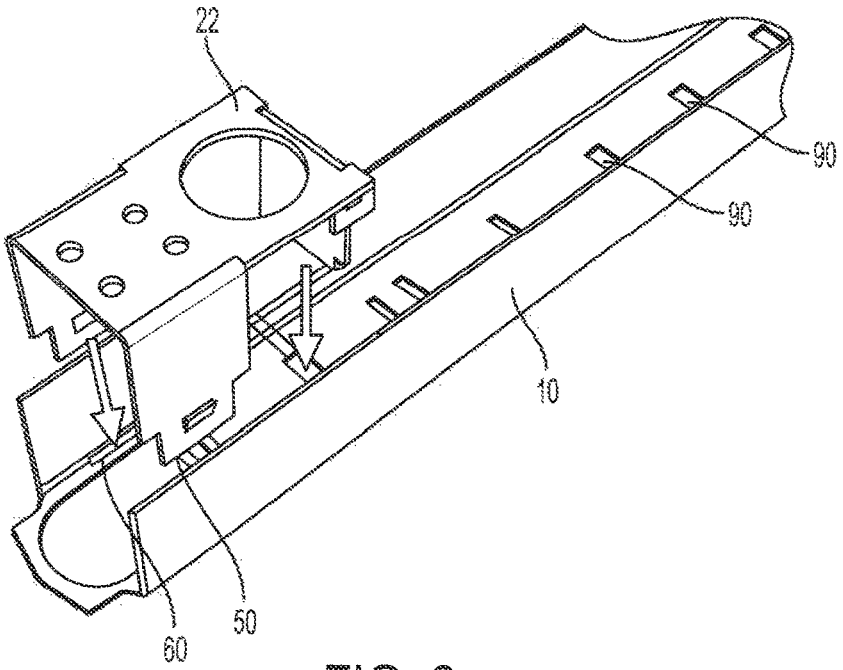
FIG. 3 is an exploded perspective view of a portion of the modular channel including a flush bolt clip with a mounting opening for a door position switch.
Figure 4:
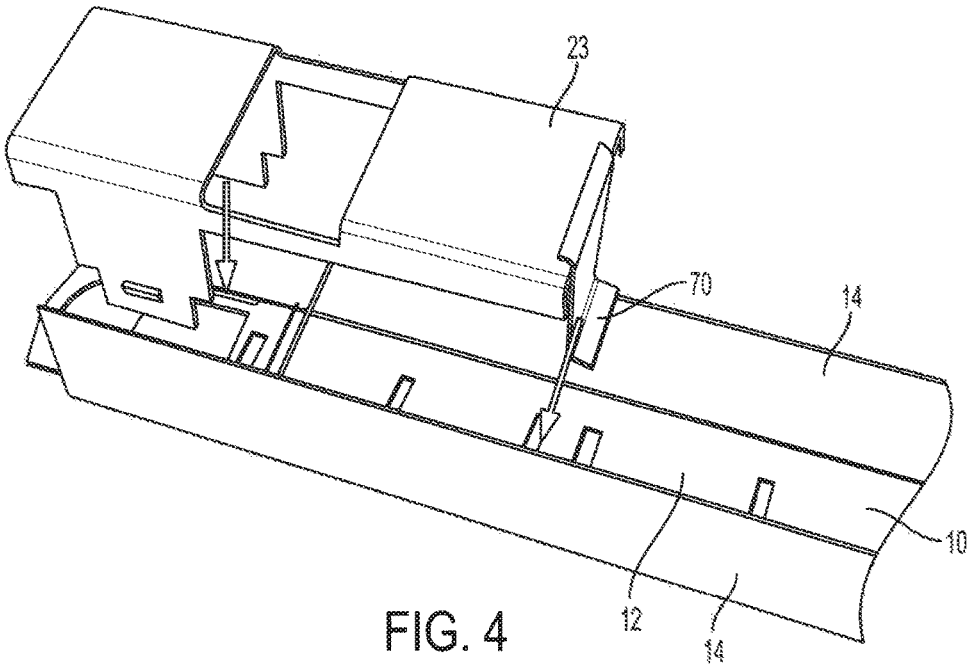
FIG. 4 is an exploded perspective view of a portion of the modular channel including a hardware adapter for a vertical rod guide.

A method of using a modular door channel to install a door is shown in FIG. 2. The elongated channel 10 is positioned as part of the framework, for example, an edge, of the door 80. The elongated channel includes at least one pair of parallel slotted openings along a portion of the base member. The channels adapters 20-25 include a pair of tabs 50 corresponding with the pair of slotted openings 60. The tabs include a locking protrusion 40 extending from tab. The channel adapter is positioned wherein the pair of tabs are aligned with the pair of parallel slotted openings. The pair of tabs are urged fully into the parallel slotted openings until the locking protrusions pass through the parallel slotted openings, locking the channel adapter into the door channel.

Figure 5A:
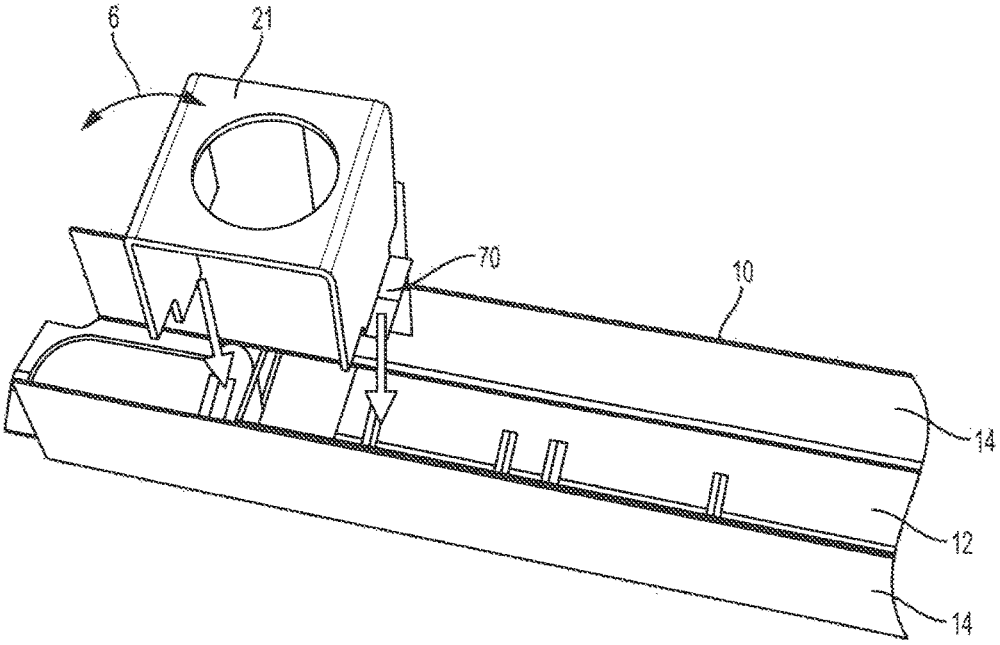
FIG. 5A is an exploded perspective view of a portion of the modular channel including a door position switch adapter.
Figure 5B:
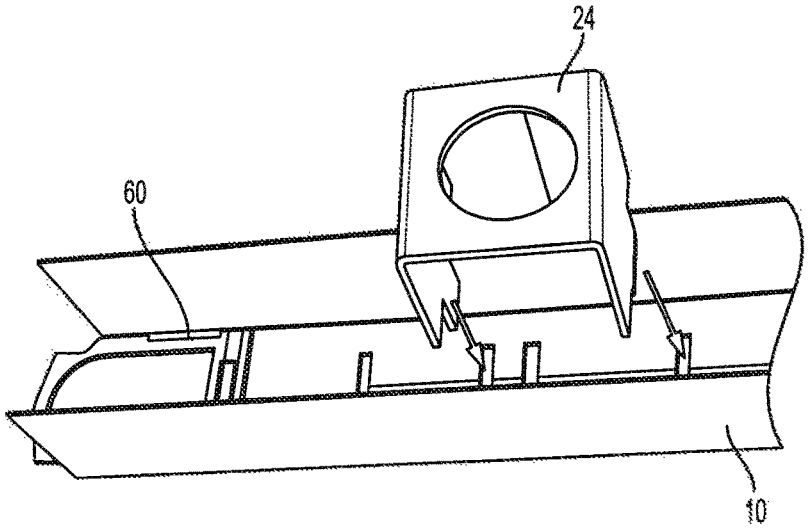
FIG. 5B is an exploded perspective view of a portion of the modular channel including a second embodiment of the door position switch adapter.
Figure 6:
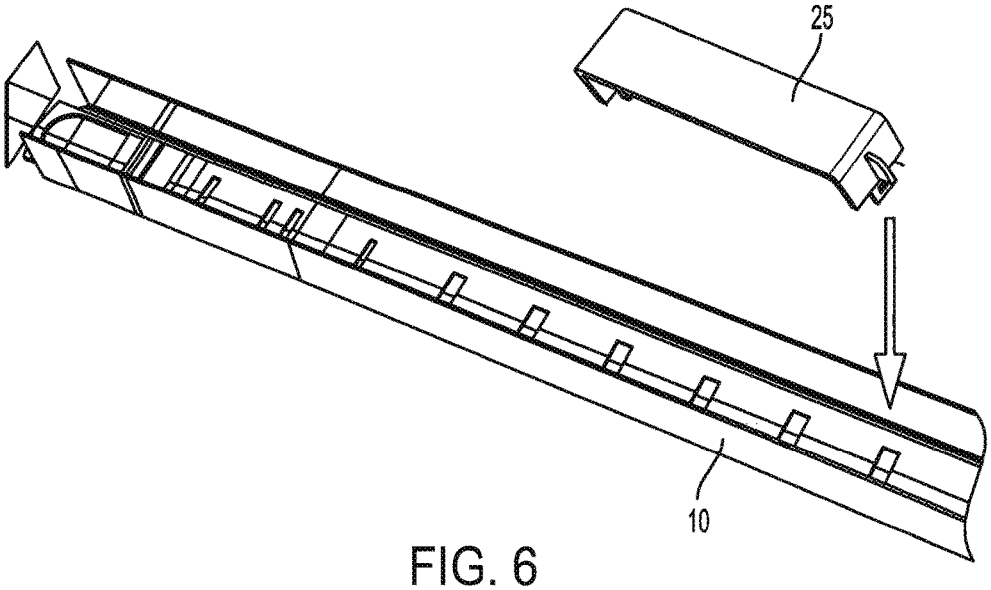
FIG. 6 is an exploded perspective view of a portion of the modular channel including concealed overhead closer adapter.

Another method of using a modular door channel to install a door is shown in FIG. 5A. The elongated channel 10 has a width W and a length L, opposing sides 14 and a base member 12 extending between one edge of the sides 14, a plurality of parallel slotted opening pairs 60 along a portion of the base member, the slots of the slotted openings 60 parallel with the length L of the elongated channel 10, and at least one transverse slot 90 extending perpendicular to the slots of the slotted openings 60. The channel adapters 20-25 include a pair of tabs 50 corresponding with the pairs of slotted openings 60. The tabs 50 include a locking protrusion 40 extending from tab 50. The channel adapter includes a tongue 70 perpendicular to the tabs 50. The elongated channel 10 is positioned as part of the door framework. One of the channel adapters 20-25 is positioned at a desired location at a rotated 6 angle to the elongated channel 10 wherein the tongue 70 is aligned with one of the transverse slots 90. The tongue 70 is inserted into the at least one transverse slots 90 and the channel adapter 21-25 is rotated 6 so the pair of tabs 50 fully engages one of the pairs of parallel slotted openings 60 until the locking protrusions 40 pass through the parallel slotted openings 60, locking the channel adapter 20-25 into the door channel 10. The door skins and edging may be installed over the modular channel members at any suitable point before, during or after the channel adapters and associated door components are installed.

Accordingly, the present invention provides a door channel mountable to a door for attaching door components or door accessories. The present invention also provides a door channel which can be populated with modular adapters or assemblies on site and a door channel which is engagable with a various modular components, allowing easy installation and replacement of the modular components. The present invention also provides a door channel which does not require welding for assembly, reducing manufacturing time and cost. Some other advantages of the invention include eliminating the need to detail parts and prints as well as eliminating the need for welding layout of the adapters in the channel. The components snap into locations that cover 75 to 80% of custom orders and since no welding is required, the adapters can be snapped in the door on line so it reduces off line conversion and prepping channel. Doors that go to job sites and have missing preps can be snapped into place with ease. The present invention allows custom doors to become stock product and parts can be sold to suppliers in box quantities and increase productivity on door lines, reduce labor in door conversion, channel prep, and small parts and material movement to other departments. These advantages may reduce back charges.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A modular channel for a door comprising:

an elongated channel forming at least a portion of an internal frame for the door, the elongated channel having opposing sides with opposing side edges, and a base member extending between one edge of the sides;

a pair of parallel slotted openings along a portion of the base member; and a channel adapter including an adapter face and a pair of support struts extending from the adapter face, each support strut including a tab having a distal end away from the support strut, the tab engagable with the one of the slotted openings, the tabs including a locking protrusion extending from the tab, the locking protrusion disposed away from the tab end;

wherein the tabs slidably engage the slotted openings and the locking protrusions deform the slotted openings when the tabs are urged into the slotted opening.

2. A modular channel for a door comprising:

an elongated channel forming at least a portion of an internal frame for the door, the elongated channel having opposing sides with opposing side edges, and a base member extending between one edge of the sides;

wherein the slotted openings are positioned parallel with the elongated channel length and the elongated channel includes at least one transverse slot perpendicular to the pair of slotted openings;

a pair of parallel slotted openings along a portion of the base member; and a channel adapter securable between the channel sides including a pair of tabs corresponding with the pair of slotted openings, the tabs including a locking protrusion extending from the tab; and the channel adapter includes a curved locking tongue disposed perpendicular to the tabs and engagable with the transverse slot;

wherein the tabs slidably engage the slotted openings and the locking protrusions engage the slotted openings when the tabs are urged fully into the slotted opening.

3. The modular channel according to claim 1 including at least one additional pair of parallel slotted openings wherein the channel adapter may slidingly engage either pair of parallel slotted openings.

4. The modular channel according to claim 1 wherein the channel adapter includes openings to engage hardware for a motion switch.

5. The modular channel according to claim 1 wherein the locking protrusions include at least one angled surface which temporarily deforms a portion of the slot as the tab is urged into the slot until the protrusion fully passes through the slot, preventing the protrusion from backing out of the slot.

6. The modular channel according to claim 1 wherein the channel adapter includes openings to engage hardware for a closer mount.

7. The modular channel according to claim 1 wherein the channel adapter includes openings to engage hardware for a concealed overhead closer.

8. The modular channel according to claim 1 wherein the channel adapter includes openings to engage hardware for a flush bolt clip.

9. The modular channel according to claim 1 wherein the channel adapter includes openings to engage hardware for a vertical rod.

10. The modular channel according to claim 1 wherein the channel adapter includes openings to engage hardware for a support.

11. The modular channel according to claim 1 wherein the channel adapter includes openings to engage hardware for a position switch.

12. A door assembly comprising:

a door having an opening in an edge thereof;

an elongated channel secured to a door edge, the channel having a base member securable to the door edge and opposing sides extending outwardly from the base member in a direction away from the door edge;

a pair of parallel slotted openings along a portion of the base member; and a channel adapter securable between the channel sides including a pair of tabs corresponding with the pair of slotted openings, the tabs including a locking protrusion extending from tab;

wherein the tabs slidably engage the slotted openings and the locking protrusions engage the slotted openings when the tabs are urged fully into the slotted opening.

13. A method of installing a door using a modular door channel comprising:

providing an elongated channel securable to the door, a base member and opposing sides extending from the base member in a direction away from the door, the elongated channel having a pair of parallel slotted openings along a portion of the base member;

providing a door having an edge;

providing a channel adapter including a pair of tabs corresponding with the pair of slotted openings, the tabs including a locking protrusion extending from tab;

securing the elongated channel to the door edge;

positioning the channel adapter wherein the pair of tabs are aligned with the pair of parallel slotted openings; and urging the pair of tabs fully into the parallel slotted openings until the locking protrusions pass through the parallel slotted openings, locking the channel adapter into the elongated channel.

14. A method of installing a door using a modular door channel comprising:

providing an elongated channel forming at least a portion of an internal frame for the door, the elongated channel having opposing sides and a base member extending between one edge of the sides, the elongated channel having a pair of parallel slotted openings positioned parallel with the elongated channel length along a portion of the base member and at least one transverse slot perpendicular to the pair of slotted openings;

providing a door having an edge opening for engaging the elongated channel;

providing a channel adapter including a pair of tabs corresponding with the pair of slotted openings, the tabs including a locking protrusion extending from tab, and a curved locking tongue disposed perpendicular to the tabs and engagable with the transverse slot;

securing the elongated channel within the door edge opening;

positioning the channel adapter wherein the pair of tabs are aligned with the pair of parallel slotted openings and inserting the locking tongue into the at least one traverse slot; and urging the pair of tabs fully into the parallel slotted openings until the locking protrusions pass through the parallel slotted openings, locking the channel adapter into the elongated channel.

15. The method according to claim 13 wherein the elongated channel includes at least one additional pair of parallel slotted openings wherein the channel adapter may slidingly engage either pair of parallel slotted openings.

16. The method according to claim 13 wherein the locking protrusions include at least one angled surface which temporarily deforms a portion of the slot as the tab is urged into the slot until the protrusion fully passes through the slot, preventing the protrusion from backing out of the slot and the step of urging the pair of tabs fully into the parallel slotted openings includes allowing the at least one angled surface to deform a portion of the slot.

17. A method of installing a door using a modular door channel comprising:

providing an elongated channel having a width, opposing sides and a base member extending between one edge of the sides, a plurality of parallel slotted opening pairs along a portion of the base member, the slots of the slotted openings parallel with the length of the elongated channel, and at least one transverse slot extending perpendicular to the slots of the slotted openings;

providing a door;

providing a channel adapter including a pair of tabs corresponding with the pairs of slotted openings, the tabs including a locking protrusion extending from tab, the channel adapter including a tongue perpendicular to the tabs;

securing the elongated channel to form at least a portion of an internal frame for the door;

positioning the channel adapter at a desired location at an angle to the elongated channel wherein the tongue is aligned with one of the transverse slots;

inserting the tongue into the at least one transverse slots; and rotating the channel adapter, and urging the pair of tabs fully into the one of the pairs of parallel slotted openings until the locking protrusions pass through the parallel slotted openings, locking the channel adapter into the elongated channel.

18. The method according to claim 17 wherein the slotted openings are positioned parallel with the enlongated channel length and the elongated channel includes the at least one transverse slot perpendicular to the pair of slotted openings and the channel adapter includes a curved locking tongue disposed perpendicular to the tabs, the tongue engagable with the transverse slot and the step of positioning the channel adapter includes inserting the locking tongue into the at least one traverse slot.

19. The method according to claim 17 wherein the locking protrusions include at least one angled surface which temporarily deforms a portion of the slot as the tab is urged into the slot until the protrusion fully passes through the slot, preventing the protrusion from backing out of the slot and the step of urging the pair of tabs fully into the parallel slotted openings includes allowing the at least one angled surface to deform a portion of the slot.

20. The method of claim 17 including providing a second channel adapter and positioning the second channel adapter at a desired location at an angle to the elongated channel wherein the second tongue is aligned with another of the transverse slots, inserting the second tongue into the another of at least one transverse slots, rotating the second channel adapter, and urging the second pair of tabs fully into another of the pairs of parallel slotted openings until the second locking protrusions pass through the second parallel slotted openings, locking the second channel adapter into the elongated channel.

* * * * *